US005435045A

United States Patent [19]

Anscher

[11] Patent Number: 5,435,045

[45] Date of Patent: Jul. 25, 1995

[54] TENSION FASTENER FOR USE WITH BACKPACKS AND THE LIKE

[75] Inventor: Joseph Anscher, Port Washington, N.Y.

[73] Assignee: National Molding Corp., Farmingdale, N.Y.

[21] Appl. No.: 83,825

[22] Filed: Jun. 25, 1993

[51] Int. Cl.[6] ..... A44B 21/00

[52] U.S. Cl. ..... 24/482

[58] Field of Search ..... 24/482, 481, 487, 495, 24/578, 505

[56] References Cited

U.S. PATENT DOCUMENTS 3,627,300 12/1971 Caveney ..... 24/482 X 5,115,542 5/1992 Gehres ..... 24/543

5,277,387 1/1994 Lewis et al. ..... 24/487 X

FOREIGN PATENT DOCUMENTS 118458 4/1944 Australia ..... 24/501

*Primary Examiner*—James R. Brittain

*Attorney, Agent, or Firm*—Kenyon & Kenyon

[57] ABSTRACT

A fastener for holding a tool under tension against the outer surface of a backpack or the like. The fastener includes a pair of interlockable members which are coupled by an elastic member which exhibits resistance to stretching. The fastener may be looped around a conventional attachment means, such as a lash tab, commonly provided on a backpack. The fastener may be opened and closed quickly and easily without readjusting its size each time.

19 Claims, 6 Drawing Sheets

TENSION FASTENER FOR USE WITH BACKPACKS AND THE LIKE

BACKGROUND OF THE INVENTION

1. Field of the Invention

The invention relates generally to fasteners for holding equipment, such as hiking and climbing tools, to backpacks and the like, and more particularly to a tension fastener for firmly securing an ice axe or the like to a backpack.

2. Description of Related Art

In hiking and climbing, it is quite common for participants to carry tools such as ice axes, pick axes, etc... Often, such tools are carried on the outside of backpacks which have various means for attaching the tools. The most common means employed includes a loop and an adjustable strap and buckle combination. The loop is attached to the lower part of the back surface of the backpack, and the strap and buckle combination is attached to the upper part of the back surface. In the case of an ice axe, the hammer end of the tool is typically inserted and twisted in the loop and the opposite end of the tool (i.e., the handle portion) is held against the backpack by the strap and buckle. In this position, the ice axe is held in place.

Although an ice or pick axe may be effectively carried on the backpack in this manner, the use of a strap and buckle has several disadvantages. The strap and buckle can be difficult to manipulate, particularly in cold and/or snowy environments where gloves or mittens are commonly worn. For example, engagement, disengagement and adjustment of the strap and buckle typically involves feeding and winding the strap through the buckle cross bars and teeth which may be difficult or impossible while wearing gloves. Moreover, even without gloves, adjustment of the strap and buckle can be cumbersome.

Another disadvantage is that, after repeated use, the teeth of the buckle will wear and possibly fray the strap which can result in an insecure fastening.

Accordingly, it would be desirable to provide a fastener for use with a backpack which is quick and easy to use and which has an increased wear resistance.

SUMMARY OF THE INVENTION

It is an object of the invention to provide a fastener for securing a tool, such as an ice axe, to a backpack or the like which can be quickly and easily engaged and disengaged, with little dexterity.

It is a further object of the invention to provide such a fastener which does not require adjustment, or which can be adjusted very easily.

It is yet a further object of the invention to provide such a fastener which holds the tool in position against the backpack under tension.

These and other objects are achieved by the present invention which provides a tension fastener for use with a backpack and the like. The fastener includes interlockable male and female members which are coupled near their proximal ends by an elastic cord (e.g., a shock cord) or the like which is capable of holding an object under tension when stretched. Each of the male and female members includes at least one aperture for receiving the cord. The length of cord between the members is adjusted by knotting the cord on the outside of the aperture at the desired location. The aperture is small enough to prevent the knot from passing therethrough, thereby setting a maximum cord length between the male and female members.

The length of the cord between the members is adjusted (by knotting) to suit the size of the particular tool to be held. The length of the cord should be such that when the male and female members are engaged around the periphery of the tool, the cord is stretched so that the fastener holds the tool under tension. Preferably, the length of the cord is properly adjusted for the particular tool to be held before the fastener is applied to the backpack so that no adjustment is required during use.

The fastener may be applied to a backpack by feeding and looping it around an attachment means (e.g., a lash tab with a loop) which is commonly provided on the outside of backpacks for receiving, e.g., a strap and buckle combination.

The male member is an arcuate plastic member having an upwardly projecting hook at or near its distal end. The hook preferably has a head region and a neck region, however, any other configuration which allows the male member to interlock with the female member may be utilized. The female member is an arcuate plastic member which has a locking aperture defined therein. The locking aperture is keyhole shaped having an expanded region and a slot which extends from the expanded region in the distal direction. The expanded region is large enough for receiving the head region of the hook, but the slot is too narrow for this purpose. However, the slot is wide enough to accommodate the neck region of the hook.

In use, the fastener is looped around the attachment means belonging to the backpack as well as around the part of the tool to be held (e.g., the handle portion). The opposing male and female members are then interlocked by pulling them toward each other and inserting the hook through the underside of the locking aperture. This is followed by sliding the neck region of the hook through the slot in the distal direction to the distal end of the slot. The tension of the stretched shock cord coupling the male and female members will force this sliding motion and continually urge the members to remain in this locked position, thereby securing the tool to the backpack under tension.

To open the fastener, the male and female members are disengaged by squeezing them closer to slide the neck region of the hook through the slot and toward the expanded region of the locking aperture, where the female member is now free to be lifted from the hook.

DETAILED DESCRIPTION OF THE INVENTION

Figure 6:
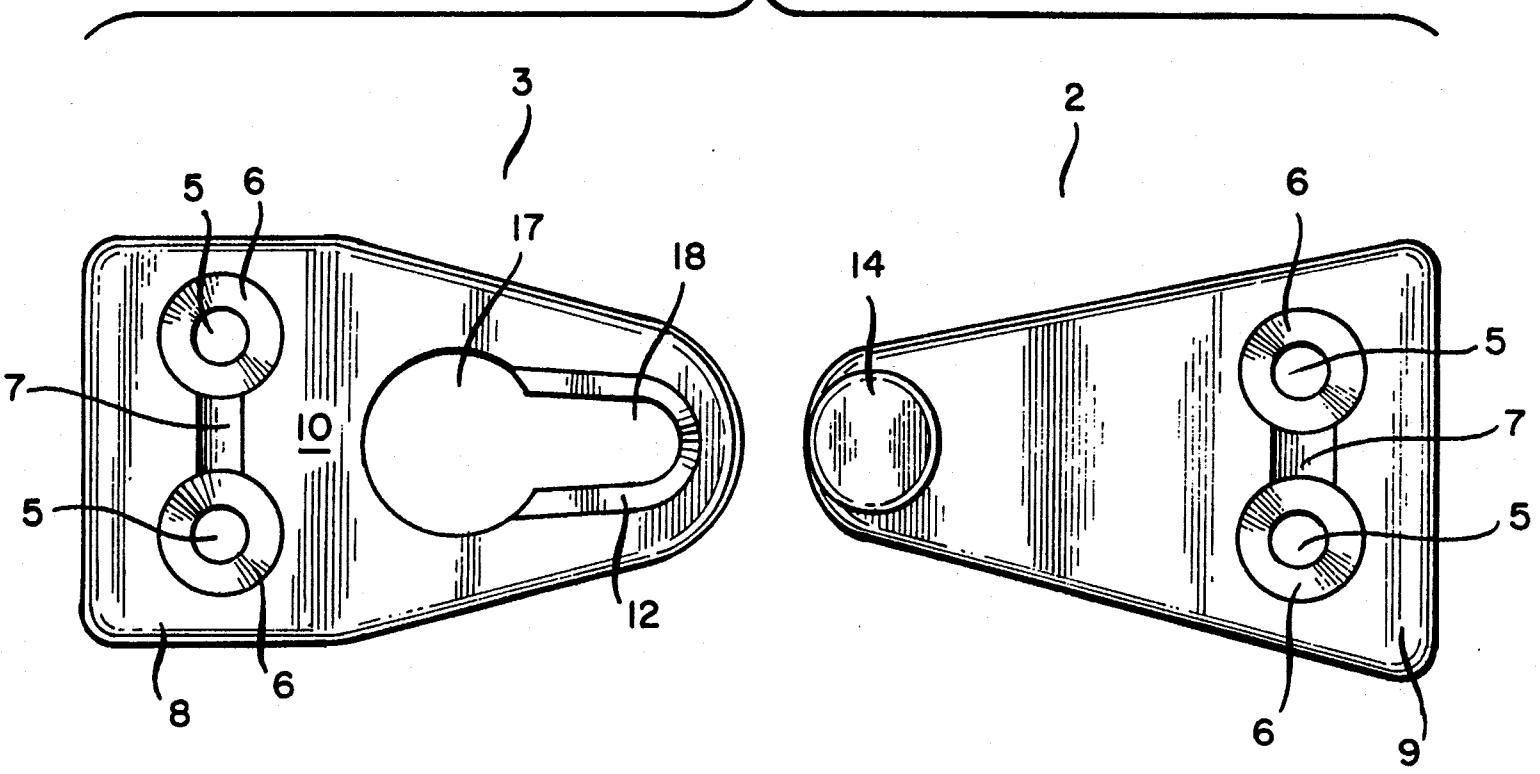
FIG. 6 is a top view of individual male and female members of a tension fastener in accordance with the invention.
Figure 7:
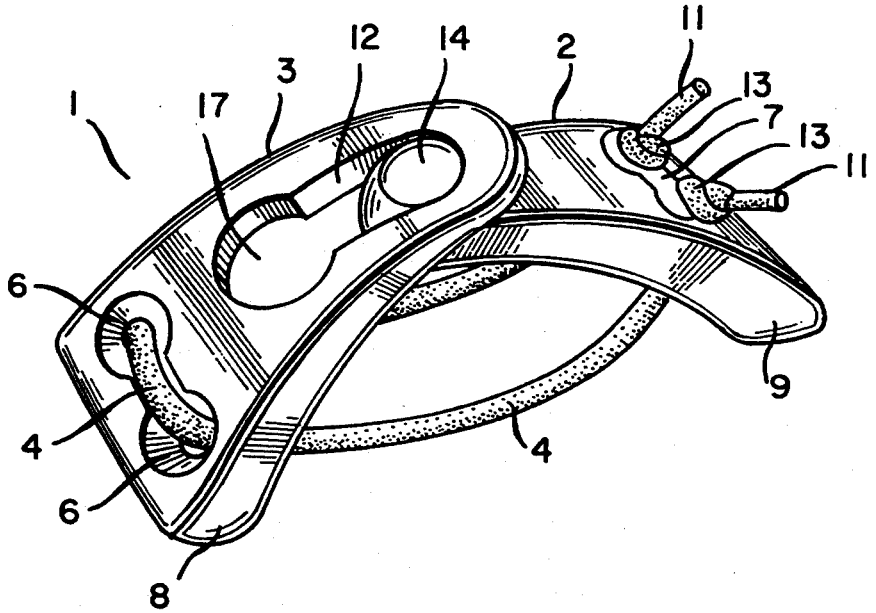
FIG. 7 is a perspective view of a first embodiment of a tension fastener in accordance with the invention.

Referring to FIGS. 6 and 7, one embodiment of a fastener in accordance with the invention is generally illustrated at 1. The fastener includes a male engaging member 2 and a female engaging member 3 which are coupled by an elastic cord 4. The cord 4 is one which is capable of being stretched, but which exhibits great resistance to even a small amount of stretching, such as a shock cord. Such cords are known in the art of baggage carts and the like. Shock cords are preferred because of their great durability. Alternatively, any elastic member which exhibits resistance to stretching may be utilized such as a spring.

Each of the male member and the female member is preferably molded from a hard durable plastic. Conventional techniques may be used to mold these parts—no special adaptations are required.

Both the male member and the female member define a pair of apertures 5 therein for receiving the cord 4. Each aperture 5 is preferably bevelled with a slanted surface 6 and joined to its adjacent aperture by an adjoining channel 7 for facilitating threading of the cord 4 through and between the apertures. The channel 7 is not an opening, but is merely a depression or groove on the fastener surface. The proximal section 8 of the female engaging member 3 is coupled to the proximal section 9 of the male engaging member 2 by looping a length of elastic cord through the apertures 5 of the female member 3 and over channel 7 (on the topside 10 of member 3) as illustrated in FIGS. 6 and 7. The free ends 11 of the cord are then fed through the respective apertures 5 belonging to the male engaging member 2 from the underside of the male member.

To fix the size of the fastener 1, each of the free ends 11 is knotted 13 at a suitable location. The size of the apertures 5 is constructed too small to permit the knots 13 to pass therethrough, thereby fixing the size of the fastener.

An important advantage of the invention is that once the size of the fastener is adjusted to snugly fit the particular article to be held under tension, no further adjustment is required during use because the fastener holds the tool under tension. In other words, each time the fastener is opened to remove the tool, no adjustment is required to subsequently close the fastener around the tool after the tool has been used.

Figure 4:
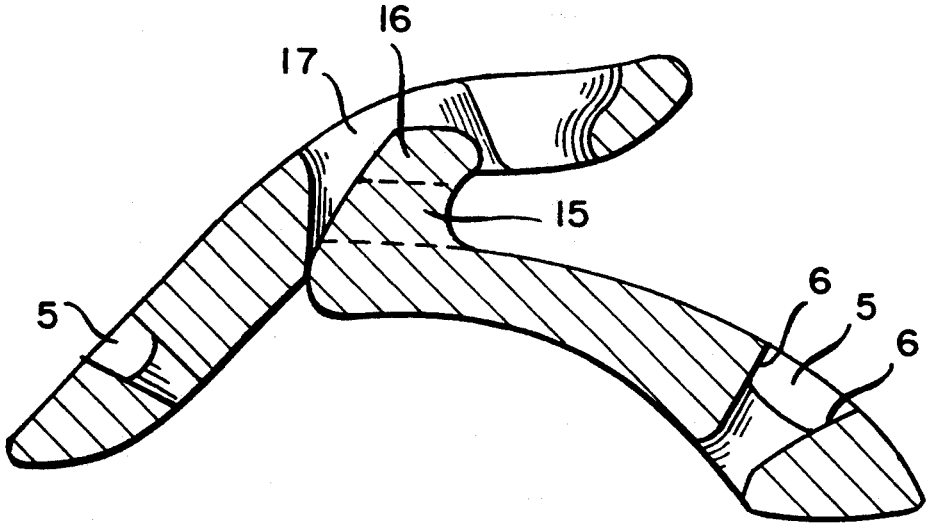
FIG. 4 is a cross-sectional view of individual male and female members of a tension fastener in accordance with the invention being engaged.
Figure 5:
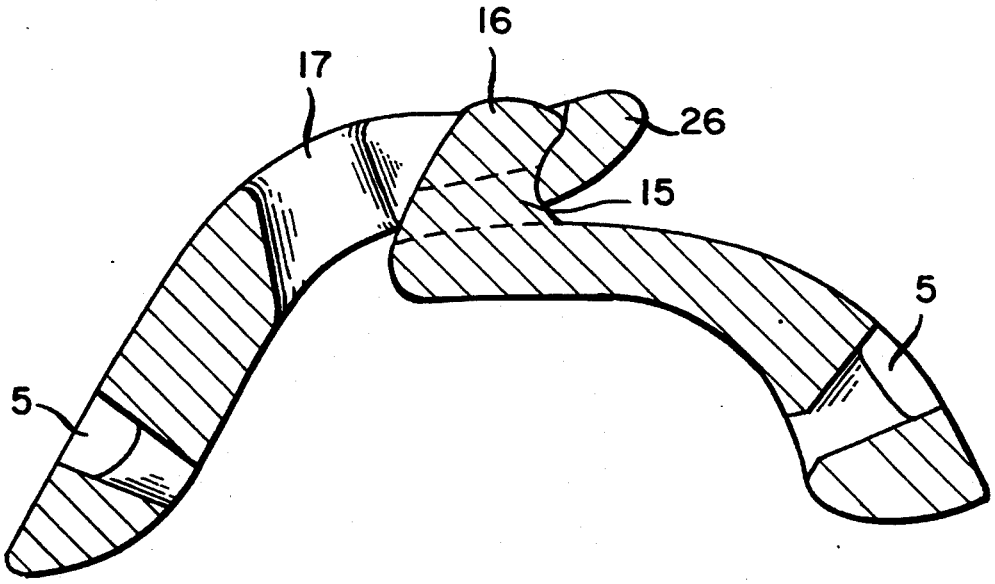
FIG. 5 is a cross-sectional view of the members of FIG. 4 in the engaged position.

The male engaging member 2 includes an upwardly projecting hook 14 (best seen in FIGS. 4 and 5) at or near its distal end. Preferably, the hook 14 includes a tapered neck region 15 and a widened head region 16. The head 16 may be bulbous in shape, or it may be a straight bar which defines a T-shape with the neck 15, or it may have any other configuration which permits the hook 14 to interlock with the female member. The female engaging member 3 defines a keyhole shaped locking aperture having an expanded region 17 joined to a slot 18. The slot extends from the expanded region in the distal direction. The hook 14 and locking aperture 17, 18 are designed for cooperative engagement as follows.

The expanded region 17 of the locking aperture is constructed to be large enough to receive the head region 16 of the hook 14 on the male engaging member 3. On the other hand, the slot 18 is too narrow to receive the head 16. However, the slot 18 is wide enough to accommodate the neck region 15 of the hook to permit sliding of the neck therethrough. The slot 18 may have a bevelled surface 12 (see FIG. 6) for facilitating sliding of the neck region 15 of the hook 14 therethrough. The bevelled surface 12 will also permit the slot 18 to have a tapered lower section and a widened upper section whereby the head region 16 of the hook 14 may sit within the widened upper section (with the neck region 15 in the tapered lower section) in the engaged position (see FIG. 7). In this way, the head region 16 will not project upward out of the slot 18 in the engaged position.

Figure 1:
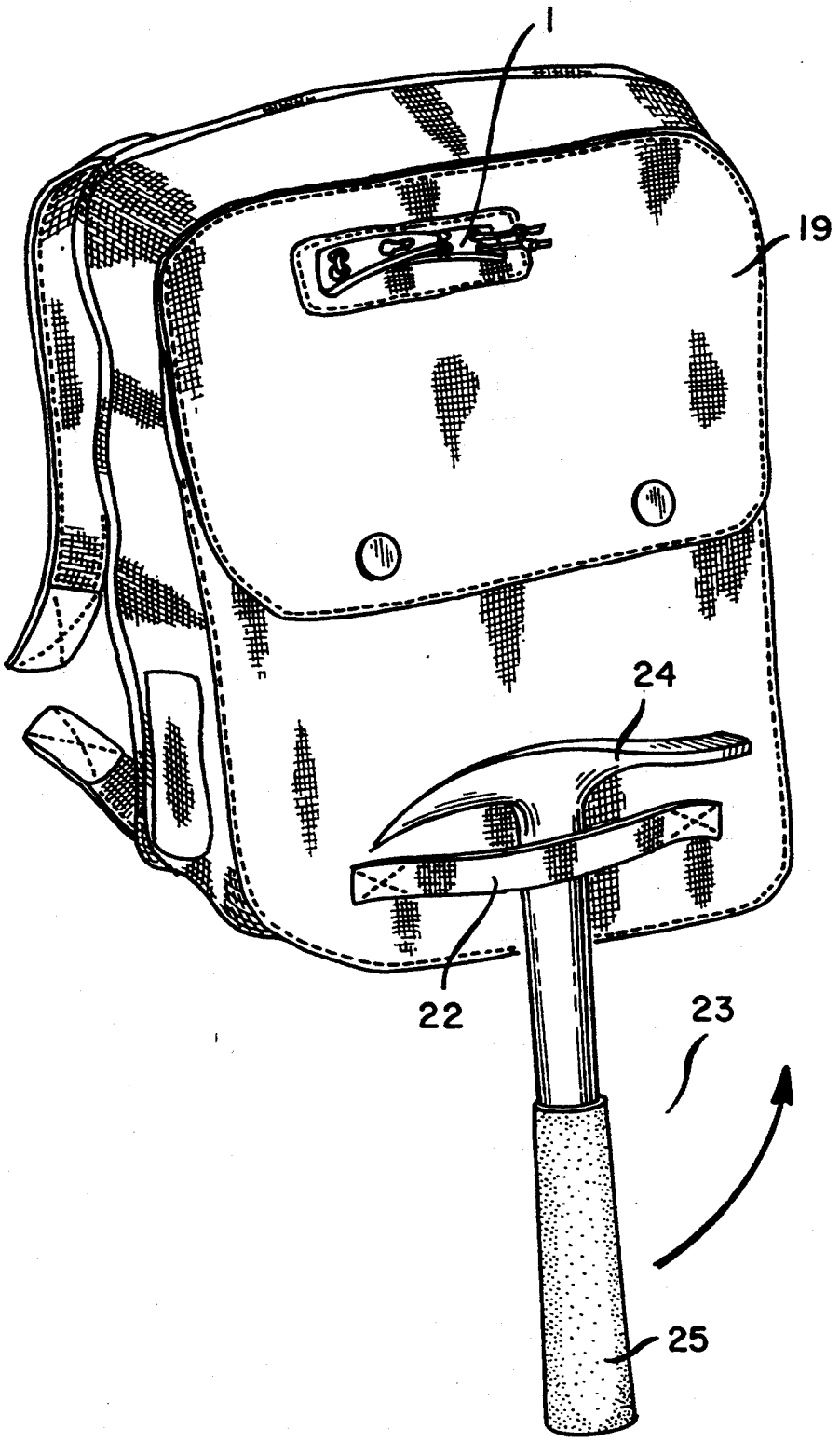
FIG. 1 depicts a backpack and a tool which is about to be fastened to the backpack using a tension fastener in accordance with the invention.
Figure 2:
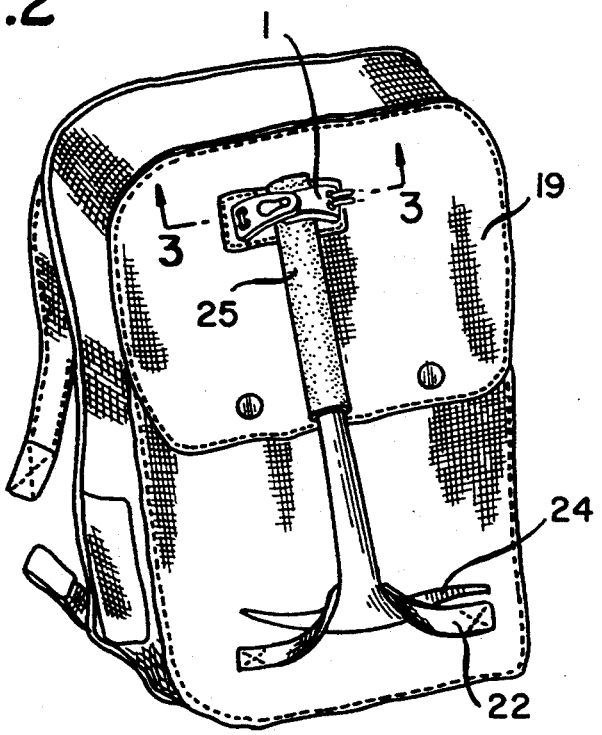
FIG. 2 depicts a backpack and a tool which is fastened thereto using the fastener of the invention.
Figure 3:
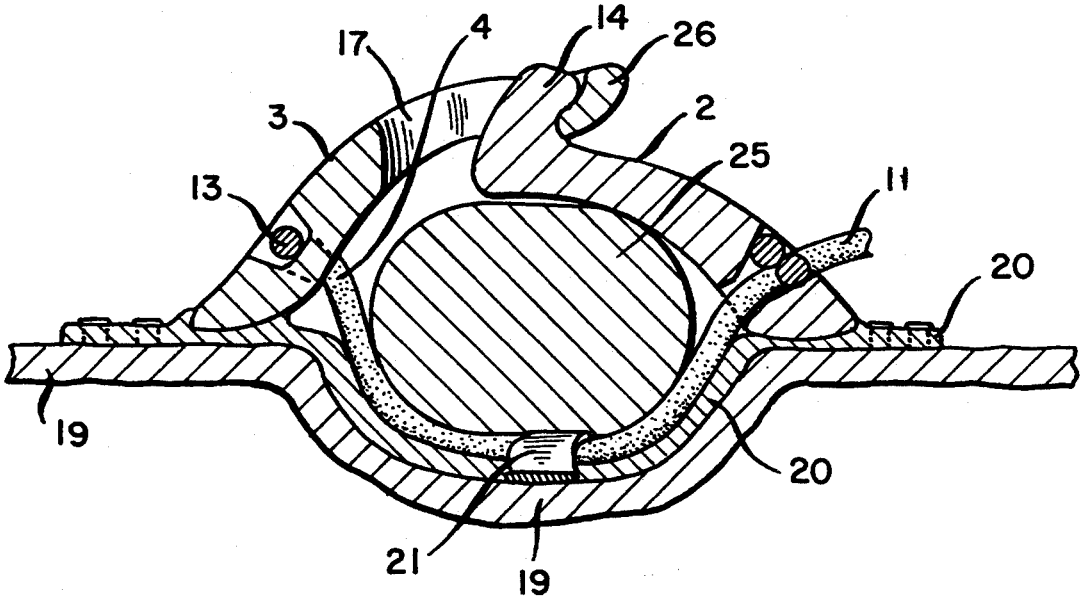
FIG. 3 is a cross-sectional view taken along the line 3—3 in FIG. 2.

In use, the fastener 1 is looped around an attachment means which is commonly provided on the upper portion of the back surface of a canvass backpack 19 (see FIGS. 1–3) for attaching, e.g., a strap and buckle combination or the like. One particularly common form of attachment means is a lash tab 20 which is typically a patch of leather stitched to the canvass backpack. The lash tab has a loop 21 which serves as the attachment means (see FIG. 3).

A backpack 19 used for winter hiking typically has a larger canvass loop 22 on the lower section of its back surface for assisting in the holding of an ice axe 23 or the like. To attach the ice axe 23 to the backpack, the hammer end 24 of the ice axe 23 is first inserted into the loop 22 in an upward direction from beneath the loop (see FIG. 1). The handle 25 of the axe is then flipped from bottom to top so that the loop 22 is twisted about the hammer end 24 to support the hammer end (see FIG. 2). The axe is retained against the backpack by closing the fastener around the handle 25 to couple the handle to the lash tab (see FIGS. 2 and 3).

The engaging members 2 and 3 of the fastener are interlocked by squeezing them together around the handle 25 until the hook 14 is received into the expanded region 17 of the locking aperture. The female member 3 is then pushed down over the hook (see FIG. 4) so that the head 16 clears the locking aperture and the neck 15 is free to slide through slot 18 away from region 17 (see FIG. 5). The fastener is now in a locked position, holding the handle 25 against the backpack 19 under tension.

To open the fastener, the members 2 and 3 are disengaged by squeezing them together to force the hook 14 toward expanded region 17 of the locking aperture, where the female member 3 may be lifted off the hook. It should be appreciated that little dexterity is required to open and close the fastener, which represents a distinct advantage over the prior art.

The male member 2 is an arcuate member which is preferably contoured to generally correspond to the shape of the handle 25 of the tool to be held since the underside surface of the male member will make contact with the handle 25 in the closed position. The female member 3 is also preferably arcuate so that its underside surface will make face to face contact with the surface of the handle 25 in the closed position. However, the distal end of the female member preferably extends straight or bends slightly upward in the distal direction so as to define a lever 26 (see FIGS. 3 and 5) for facilitating lifting of the female member 3 off the male member 2 during disengagement of the two.

Figure 8:
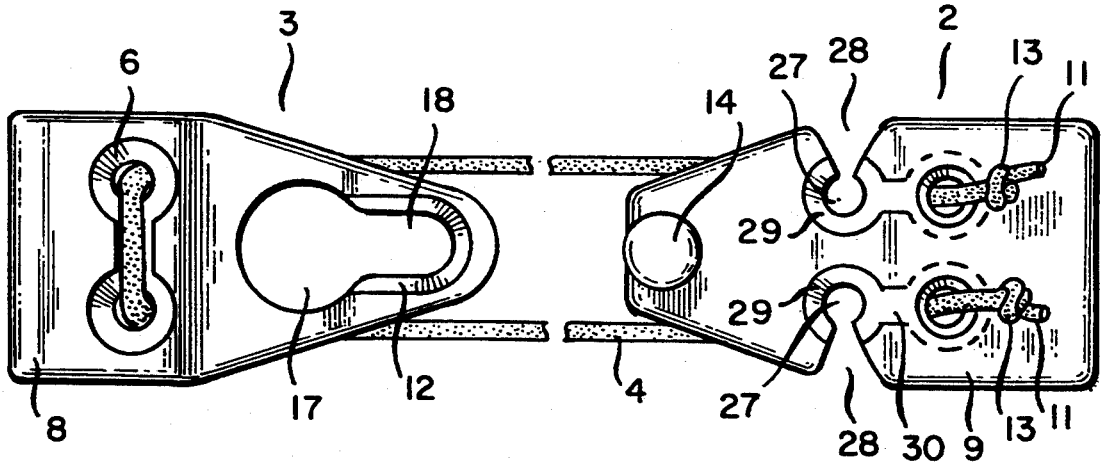
FIG. 8 is a top view of a second embodiment of a tension fastener in accordance with the invention.
Figure 9:
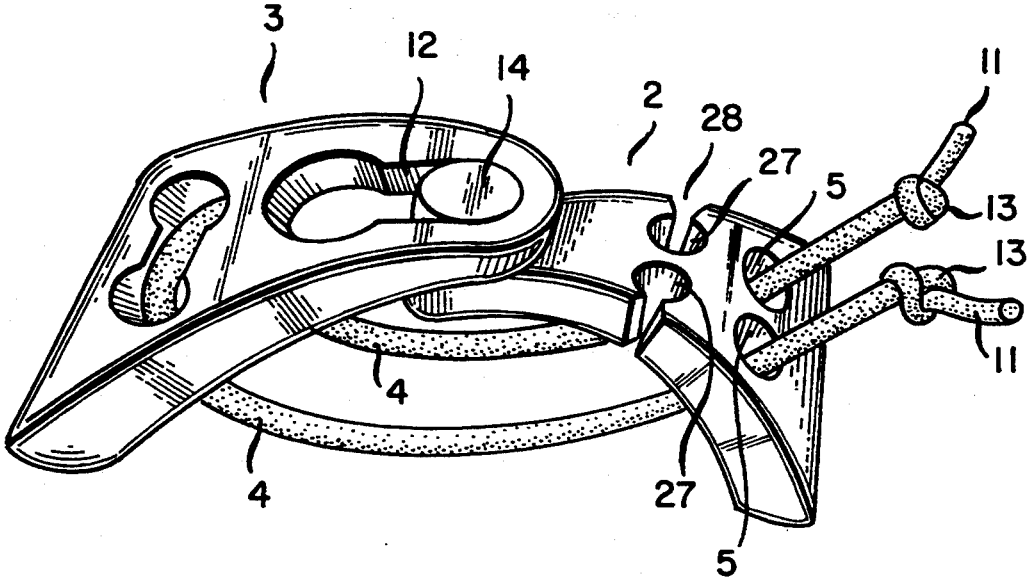
FIGS. 9 and 10 are perspective views of the fastener of the second embodiment of the invention being adjusted.
Figure 10:
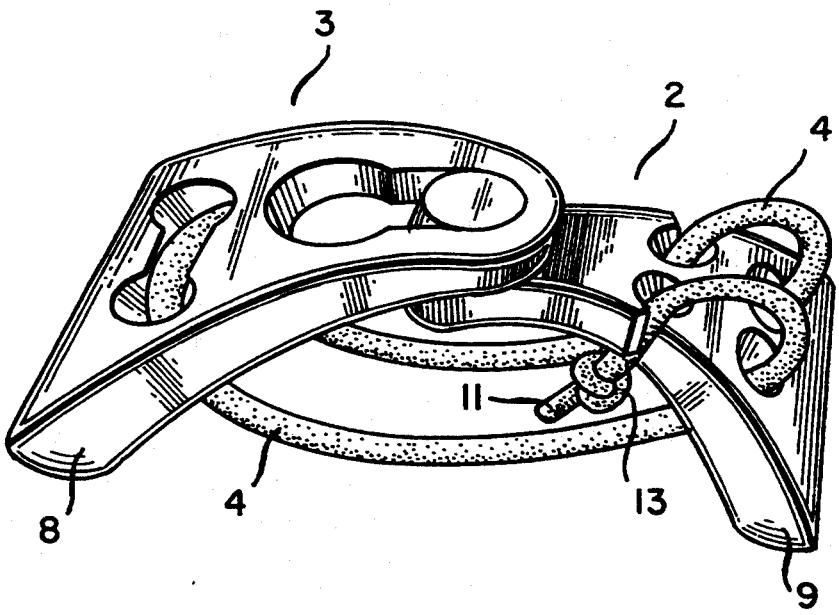

Another embodiment of the invention is illustrated in FIGS. 8–10. This embodiment is identical in all respects to the embodiment of FIGS. 1–7 as indicated by the use of common reference numerals, except for an additional adjustability feature. The male engaging member 2 defines a pair of adjustment apertures 27, distally adjacent to the pair of apertures 5. Unlike apertures 5, these adjustment apertures 27 are open 28 to the sides of the fastener body as illustrated in FIGS. 8 and 9. Each adjustment aperture 27 may be bevelled at surface 29 to facilitate threading and feeding of elastic cord 4 therethrough. In addition, adjacent apertures 5 and 27 may be joined by channels 30 (similar in configuration to channels 7) for this purpose.

In order to reduce the size of the fastener, the knot 13 of each end of cord 4 is pulled upward away from aperture 5 (see FIG. 9). Each end section of the cord 4 is now inserted through the side openings 28 of adjustment apertures 27 to position the knots 13 on the underside of the male member 2 (see FIG. 10). The knots 13 are restrained from passing through apertures 27 which are substantially the same size as apertures 5. The section of each end of the cord pulled over the fastener between apertures 5 and 27 may be aligned in the channel therebetween.

Thus, it can be seen that when the ends of the cord are threaded through the adjustment apertures 27 in the manner described above, the overall circumference of the fastener is decreased. In this way, the fastener may be adjusted to hold a smaller object under tension without the need for opening the knots 13 in the shock cord.

In the foregoing specification, the invention has been described with reference to specific exemplary embodiments thereof. It will, however, be evident that various modifications and changes may be made thereunto without departing from the broader spirit and scope of the invention as set forth in the appended claims. Therefore, the specification is to be regarded in an illustrative rather than a restrictive sense.

What is claimed is:

1. A tension fastener for gripping a tool and retaining the tool under tension against an object, comprising: a first engaging member, a second engaging member, a means for elastically coupling the first and second engaging members which includes a pair of adjacent apertures defined in each of the first and second engaging members and an elastic cord threaded through each pair of apertures, said elastic cord having two free ends, each free end emanating from an aperture defined by the same engaging member, and a means for interlocking the first and second engaging members to close the fastener around a tool.

2. The tension fastener according to claim 1 wherein the elastic cord is a shock cord.

3. The tension fastener according to claim 1 wherein each free end is knotted to define a knot, and wherein the aperture from which each free end emanates is constricted relative to the knot belonging to the respective free end, thereby preventing decoupling of the first and second members.

4. The tension fastener according to claim 1 wherein one of the engaging members further defines a pair of adjustment apertures, each adjustment aperture being open to a side of the member to which it belongs to permit further threading of the elastic cord therethrough.

5. The tension fastener according to claim 4 wherein the means for interlocking the first and second engaging members includes a hook belonging to the first member and an engaging aperture defined by the second member for receiving the hook to close the fastener.

6. The tension fastener according to claim 5 wherein the hook is an upwardly projecting member having a neck and a head, and wherein the engaging aperture includes an expanded region and a constricted region, the expanded region capable of receiving the head and neck and the constricted region capable of receiving the neck from the expanded region to interlock the first and second members and close the fastener.

7. The tension fastener according to claim 1 wherein the means for interlocking the first and second engaging members includes a hook belonging to the first member and an engaging aperture defined by the second member for receiving the hook to close the fastener.

8. The tension fastener according to claim 7 wherein the hook is an upwardly projecting member having a neck and a head, and wherein the engaging aperture includes an expanded region and a constricted region, the expanded region capable of receiving the head and neck and the constricted region capable of receiving the neck from the expanded region to interlock the first and second members and close the fastener.

9. A tension fastener for gripping a tool and retaining the tool under tension against an object, comprising: a first engaging member; a second engaging member; a means for elastically coupling the first and second engaging members which includes a pair of adjacent apertures defined in each of the first and second engaging members and an elastic cord threaded through each pair of apertures; a pair of adjustment apertures defined in one of said engaging members, each adjustment aperture being open to a side of the member to which it belongs to permit threading of the elastic cord through the adjustment apertures; and a means for interlocking the first and second engaging members to close the fastener around a tool.

10. The tension fastener according to claim 9 wherein the elastic cord is a shock cord.

11. The tension fastener according to claim 9 wherein the elastic cord has two free ends, each free end emanating from an aperture defined by the same engaging member.

12. The tension fastener according to claim 11 wherein each free end is knotted to define a knot, and wherein the aperture from which each free end emanates is constricted relative to the knot belonging to the respective free end, thereby preventing decoupling of the first and second members.

13. The tension fastener according to claim 12 wherein the means for interlocking the first and second engaging members includes a hook belonging to the first member and an engaging aperture defined by the second member for receiving the hook to close the fastener.

14. The tension fastener according to claim 13 wherein the hook is an upwardly projecting member having a neck and a head, and wherein the engaging aperture includes an expanded region and a constricted region, the expanded region capable of receiving the head and neck and the constricted region capable of receiving the neck from the expanded region to interlock the first and second members and close the fastener.

15. The tension fastener according to claim 9 wherein the means for interlocking the first and second engaging members includes a hook belonging to the first member and an engaging aperture defined by the second member for receiving the hook to close the fastener.

16. The tension fastener according to claim 15 wherein the hook is an upwardly projecting member having a neck and a head, and wherein the engaging aperture includes an expanded region and a constricted region, the expanded region capable of receiving the head and neck and the constricted region capable of receiving the neck from the expanded region to interlock the first and second members and close the fastener.

17. A tension fastener for gripping a tool and retaining the tool under tension against an object, comprising: a first engaging member, a second engaging member, a means for elastically coupling the first and second engaging members and a means for interlocking the first and second engaging members to close the fastener around a tool, the means for interlocking including a hook belonging to the first member and an engaging aperture defined by the second member for receiving the hook, wherein the hook is an upwardly projecting member having a neck and a head, and wherein the engaging aperture includes an expanded region and a constricted region, the expanded region capable of receiving the head and neck and the constricted region capable of receiving the neck from the expanded region to interlock the first and second members and close the fastener.

18. The tension fastener according to claim 17 wherein the means for elastically coupling includes at least one aperture defined in each of the first and second engaging members and an elastic cord threaded through said apertures.

19. The tension fastener according to claim 17 wherein the elastic cord is a shock cord.

* * * * *